US006024658A

United States Patent [19]

Marshall

[11] Patent Number: 6,024,658

[45] Date of Patent: Feb. 15, 2000

[54] GAME BALL MONITORING METHOD AND APPARATUS

[76] Inventor: John Reuben Marshall, 23 Colonels La., Chertsey, Surrey, KT16 8RH, United Kingdom

[21] Appl. No.: 08/776,436

[22] PCT Filed: Jul. 31, 1995

[86] PCT No.: PCT/GB95/01809

§ 371 Date: Jan. 28, 1997

§ 102(e) Date: Jan. 28, 1997

[87] PCT Pub. No.: WO96/04047

PCT Pub. Date: Feb. 15, 1996

[30] Foreign Application Priority Data

Jul. 29, 1994 [GB] United Kingdom ..... 9415359
Aug. 23, 1994 [GB] United Kingdom ..... 9416991

[51] Int. Cl.[7] ..... A63B 61/00

[52] U.S. Cl. ..... 473/467

[58] Field of Search ..... 473/467, 459; 273/358, 371; 345/147

[56] References Cited

U.S. PATENT DOCUMENTS

| | | | |
|---|---|---|---|
| 3,727,069 | 4/1973 | Crittenden, Jr. et al. | 273/358 |
| 4,004,805 | 1/1977 | Chen et al. | 273/358 |
| 4,204,683 | 5/1980 | Filippini et al. | 273/371 |
| 4,205,389 | 5/1980 | Heartz | 345/147 |
| 4,855,711 | 8/1989 | Harrop et al. | 273/358 |
| 5,516,113 | 5/1996 | Hodge | 273/371 |
| 5,626,526 | 5/1997 | Pao et al. | 473/459 |
| 5,644,335 | 7/1997 | Mielekamp | 345/147 |
| 5,820,496 | 10/1998 | Bergeron | 273/371 |

*Primary Examiner*—Jessica J. Harrison
*Assistant Examiner*—John Paradiso
*Attorney, Agent, or Firm*—Diller, Ramik & Wight, PC

[57] ABSTRACT

A method of determining in a game of tennis the point of contact of a service ball relative to a service line by (a) monitoring a field of view along the service line and producing an electronic representation of an upper boundary of the ball as it passes through the field of view, (b) scanning the upper boundary of that representation progressively in the direction of the ball flight and determining at successive spaced positions along the path of the ball the angle of definition of the boundary, and (c) comparing successive values of that angle and noting the position of the ball at which that angle reduces relatively rapidly to a lower or even a negative value. A preferred method determines and compares successive horizontal components of successive sections of the boundary which have successive equal value vertical components.

20 Claims, 6 Drawing Sheets

14
A
B
C
D
E
F
G
H
24
22
18
18
12
16
16
20
10

14
B
A
C
D
E
F
G
H
14
26
12
16
16
20
10

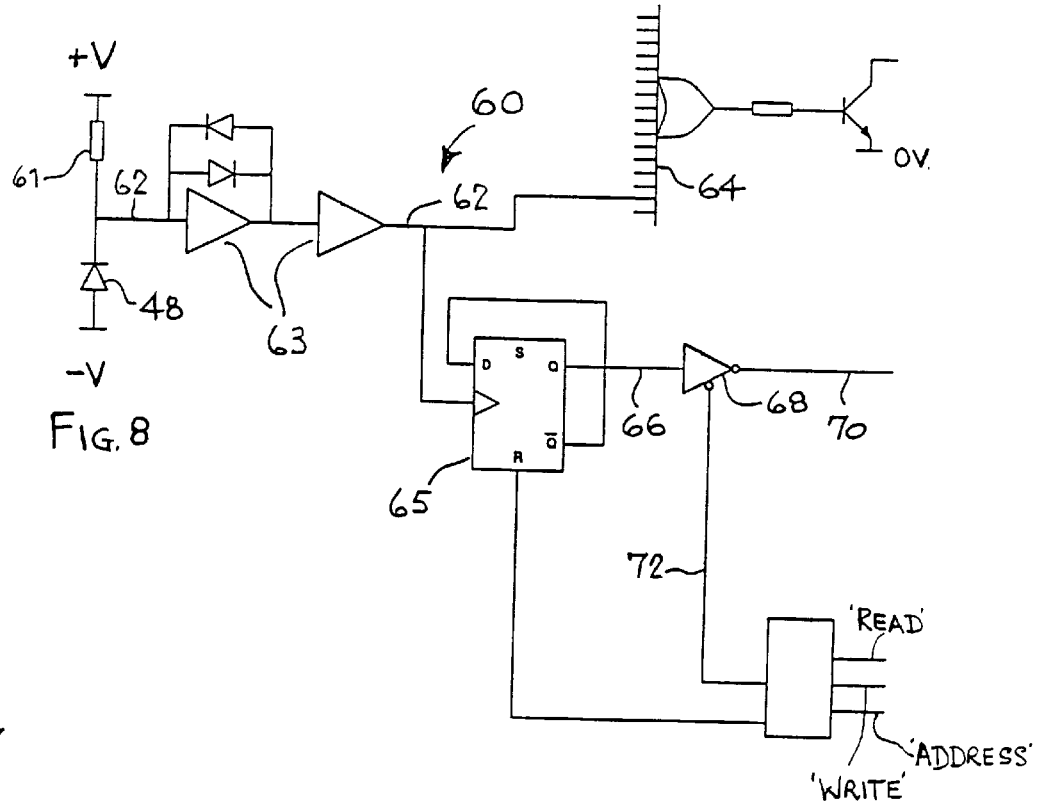
FIG. 8
FIG. 7
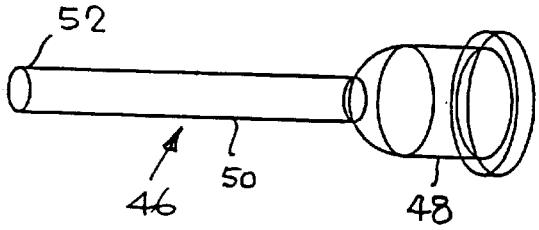
FIG. 6
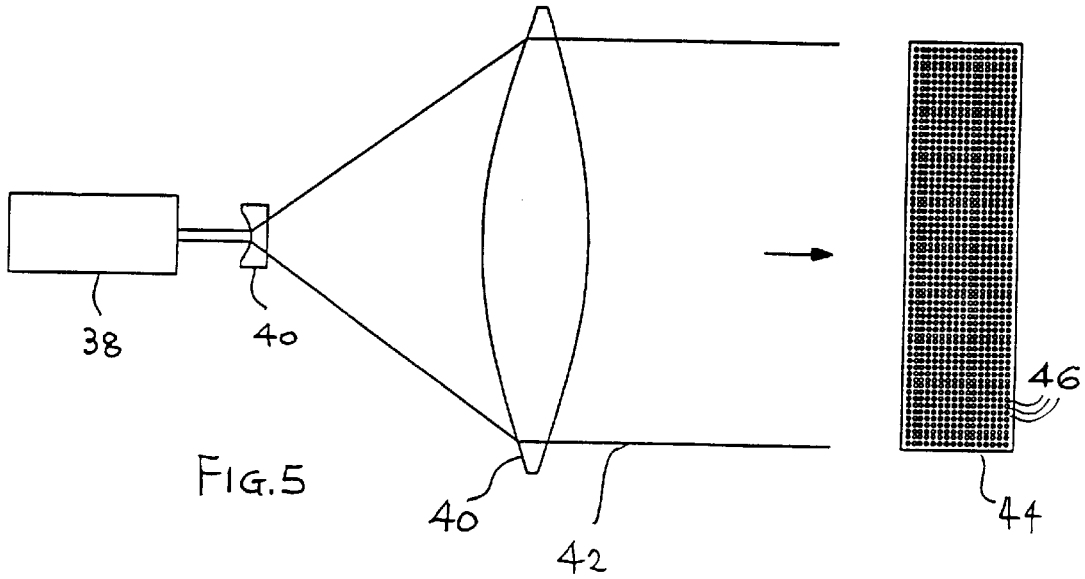
FIG. 5

GAME BALL MONITORING METHOD AND APPARATUS

This invention relates to a method and apparatus for monitoring in a ball game the position relative to a reference line at which a game ball strikes a playing surface. The invention has particular reference to the game of tennis, though it is not restricted to that game.

In what follows hereafter, the present invention will be described, for convenience and by way of example only, in the context of a game of tennis.

In the game of tennis, it is important to be able to determine with the greatest accuracy and consistency the position at which a ball on being served first strikes the playing surface relative to the 'service line'. That line defines the rearward boundary of the service area in which the served tennis ball must first strike the playing surface. A sevice which results in the ball first striking the playing surface rearward of that service line is a faulty service.

There have been various proposals to provide an apparatus for judging whether a served tennis ball has landed on the playing surface rearward or otherwise of the service line.

For a fuller understanding of the importance of this topic and apparatus, the reader's attention is directed to the following patent specifications which relate to this topic, and which deal at length with the significance of the topic:—U.S. Pat. No. 5,059,944 (CARMONA); U.S. Pat. No. 4,814,986 (SPIELMAN); & EP 0 007 720 (CARLTON ET AL).

However, there still appears to be no commercially available apparatus to reliably assist an umpire in determining whether a service is a good one or a faulty one.

The present invention seeks to provide a different approach to the topic, thereby to overcome the disadvantages of those prior proposals.

According to one aspect of the present invention, there is provided a method of monitoring in a ball game the position, relative to a reference line extending linearly between near and far ends thereof, of the first contact of a game ball with a playing surface carrying said reference line, which method includes the following steps:

(a) from said near end of the reference line, directing a single homogeous collimated beam of radiation along said reference line so as to irradiate a predetermined field at said far end of the reference line lying adjacent the reference line, said radiation beam having a transverse cross section such as will be materially but not wholly interrupted by the passage of the game ball through the beam when in play near said reference line;

(b) at the far end of the reference line, receiving at closely spaced locations in said field respective separate elements of said radiation beam, which locations are disposed in a column and row, or similar, formation;

(c) converting the respective received elements of beam radiation into corresponding electrical signals;

(d) storing the respective electrical signals in respective signal storage elements of a storage means for retention therein until reset by the passage of the game ball through the radiation beam, each said storage element when storing a said electrical signal representing an element of said radiation beam which is not interrupted by the game ball, and each said storage element when not so storing a said electrical signal representing an element of said radiation beam which is interrupted by the game ball;

(e) deriving from said storage means a representation of the path of an upper or a lower peripheral part of the game ball as the game ball impacts and bounces on the playing surface at or near the reference line whilst passing through the radiation beam;

(f) observing changes in the declination of that path; and (g) deriving from the changes in declination of that path the position of first contact of the game ball with the playing surface.

Preferably, step (e) includes the step of energising a visual display means in dependence upon the states of the respective storage elements of the storage means so as to display on a visual display screen thereof said representation of the path of said upper or lower part of the game ball during its passage through the radiation beam.

The method may also include the step of scanning the storage elements to determine a boundary separating those storage elements currently storing a said electric signal and those not so storing a said electric signal, thereby to determine the path of an upper (or a lower) peripheral part of the game ball during its passage through the radiation beam.

From that path the position of the first contact of the game ball with the playing surface may be determined.

For example, the gradient (or the angle of declination) of the path at successive positions spaced along the path may be determined; the location on the path at which the gradient (or the angle of declination) changes rapidly by a substantial amount may be determined; and from that location the position of the first contact of the game ball with the playing surface may be determined.

A substantial change in the angle of declination of said path may be determined by noting the horizontal (or vertical) component of successive sections of said path, which sections all have equal vertical (or horizontal) components, comparing successive values of said horizontal (or vertical) component, and noting the location of the game ball relative to the reference line at which the value of the horizontal component increases rapidly to a high value (or the vertical component reduces rapidly to a low value).

Said radiation preferably comprises visible light.

According to a second aspect of the present invention, there is provided an apparatus for monitoring in a ball game the position, relative to a reference line extending linearly between near and far ends thereof, of the first contact of a game ball with a playing surface carrying said reference line, which apparatus comprises:

(a) disposed at said near end of the reference line, a radiation emitting means for directing a single homogeous collimated beam of radiation along said reference line so as to irradiate a predetermined field at said far end of the reference line lying adjacent the reference line, said radiation beam having a transverse cross section such as will be materially but not wholly interrupted by the passage of the game ball through the beam when in play near said reference line;

(b) disposed at said far end of the reference line, a plurality of radiation receiving means for receiving at closely spaced locations in said field respective separate radiation elements of said radiation beam, which locations are disposed in a column and row, or similar, formation;

(c) a plurality of signal converting means for converting the respective received elements of beam radiation into respective corresponding electrical signals;

(d) signal storage means for storing the respective electrical signals in respective signal storage elements of the storage means until reset by the passage of the game ball through the radiation beam;

(e) scanning means for deriving from the storage means a representation of the flight path of an upper or a lower peripheral part of the game ball as the game ball impacts and bounces on the playing surface at or near the reference line whilst passing through the radiation beam;

(f) means for observing the declination of the flight path at successive positions on the flight path;

(g) means for deriving from changes in the declination of the flight path the position of first contact of the game ball with the playing surface.

Preferably, such an apparatus includes a visual display means; and means for energising the visual display means in dependence upon said stored electrical signals so as to display on a visual display screen thereof a spatial representation of the respective radiation elements received at said far end of the reference line by said radiation receiving means, thereby to represent on the screen the flight path of the game ball through the radiation beam.

The apparatus may also include scanning means for scanning the respective signal storage elements to determine a boundary separating those storage elements currently storing a said electric signal and those not so storing a said electric signal, thereby to determine the path of an upper (or a lower) peripheral part of the game ball whilst passsing through the radiation beam.

The apparatus may also include means for determining from said path the position of the first contact of the game ball with the playing surface.

For example, the apparatus may include means for determining the gradient (or the angle of declination) of the path at successive positions spaced along the path, means for determining the location on the path at which the gradient (or the angle of declination) changes rapidly by a substantial amount, and means for determining from that location the position of the first contact of the game ball with the playing surface.

In one embodiment, there is provided means for detecting a substantial and rapid change in the angle of declination of said path, which means includes means arranged to determine for successive sections of said path the horizontal (or vertical) component of those path sections, which path sections all have equal vertical (or horizontal) components, comparing means for comparing successive values of said horizontal (or vertical) component and arranged to provide a signal denoting the location of the game ball relative to the reference line at which the horizontal component increases rapidly to a high value (or the vertical component reduces rapidly to a low value), and means for determining from that ball location the position of the first contact of the game ball with the playing surface.

The respective equal vertical (or horizontal) components of the path sections may lie consecutively one after another. Alternatively, they may overlap one another.

The radiation emitting means preferably comprises a means for emitting a single homogeneous beam of light.

Other features of the present invention will appear from a reading of the description that follows hereafter and of the claims appended at the end of that description.

One apparatus for use in connection with the game of tennis and embodying the present invention will now be described by way of example and with reference to the accompanying diagrammatic drawings. In those drawings:

FIG. 5 shows the components forming a light source used in the apparatus;

FIG. 6 shows a more detailed front view of the light sensor array;

FIG. 7 shows the component parts of a single light sensor incorporated in the light sensor array;

FIG. 8 shows an electric circuit diagram of a bistable circuit module which incorporates the light sensor of FIG. 7;

In the respective figures, parts which appear in more than one figure or correspond to parts in another figure bear the same reference numeral in all of the respective figures.

Figure 1:
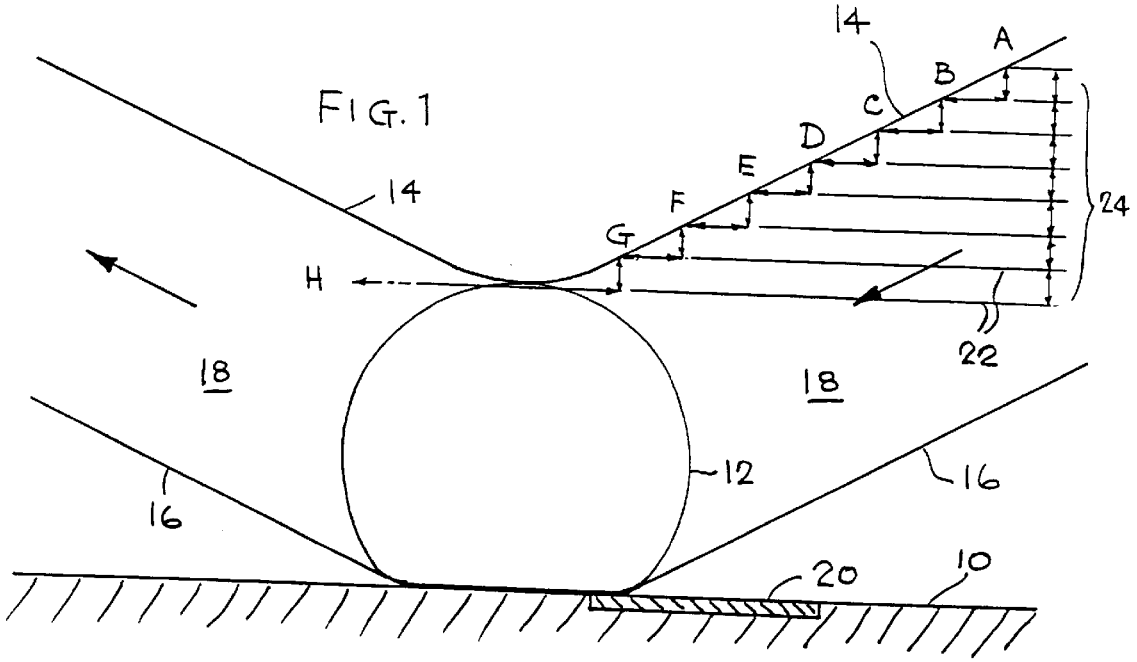
FIGS. 1 and 2 show similar side views of a tennis ball at the moment of maximum impact with the playing surface of a tennis court adjacent a service line.

Referring now to the drawings, the concept underlying the present method and apparatus will be described and explained with reference to FIG. 1. In that Figure, the tennis court playing surface is indicated at reference 10, and a tennis ball at the position of maximum contact with the ground (just before rebound) is indicated at 12. The path of the ball in flight to and from that position is defined by an upper V-shaped boundary line 14 and a lower generally V-shaped boundary line 16. The 'service line' is indicated by the rectangle 20.

The boundary lines 14 and 16 are shown as linear, but in practice on the approach side of the service line they will often be curved progressively downwardly, to an extent dependent on how the ball was served by the serving player. For example, spin applied to the ball in the service will tend to cause the flight path of the ball to be more curved as the service line is approached. Thus, the angle of declination of the ball's flight path relative to the horizontal increases as the ball approaches the service line. Likewise, the speed at which the ball is served will affect the curvature of the ball trajetory, the curvature being greater for lower ball speeds.

However, regardless of the manner of service and the ball flight path and speed produced thereby, on the approach side of the service line the flight path has generally a positive declination to the horizontal, whilst on the rebound side of the service line, the flight path has at least initially a negative declination (i.e. a positive inclination to the horizontal).

The present invention seeks to determine the position of the ball relative to the service line by determining the point at which the positive angle of declination falls relatively rapidly to a low value approaching zero, or even to a negative value, as the ball makes firm contact with the playing surface. By trial and experiment (and thus calibration of the apparatus) that position can be positively related to the position at which the ball first makes contact with the playing surface.

Any suitable means may be used (a) for determining in known manner the angle of declination of the ball flight path on its approach to the service line, and (b) ascertaining the ball position relative to the service line when there occurs a sudden drop or a reversal in the angle of declination of the flight path.

Downward curvature in the 'approach' flight path does not affect the desired determination, since that only produces an increase in the declination angle as the service line is approached. Such an increase will not affect the determination to be made, in so far as that determination is based not on an increase in the declination angle, but instead a decrease in that angle.

Likewise, any change in the curvature of the ball flight path as the ball rebounds off the playing surface will not affect the desired determination, since the declination on the initial rebound is always of negative value (as compared to that on the approach to the service line).

Instead of determining the angles of declination as such, it is easier and more convenient to determine and then compare the horizontal components of successive sections of the boundary line, which sections all have equal vertical components. This is illustrated in FIG. 1, where the points A B C D E F G H on the upper boundary line 14 are all spaced apart in a vertical direction by equal vertical components 24 of the respective boundary line sections AB, BC, CD, DE, EF, FG, GH.

The horizontal components of those sections are all equal as long as the declination of the boundary line remains constant. However, the declination reduces progressively when the ball makes contact with and becomes increasingly compressed against the playing surface. As a consequence the horizontal component of the boundary section beyond G extends indefinately on the rebound side of the service line and so its value is increased suddenly to a very high value. That sudden increase in the horizontal component indicates the lowest position of the ball before rebounding from the playing surface (i.e. the actual rebound or bounce position).

Thus, it will be appreciated that as the bounce position is closely approached, the horizontal component will suddenly increase to a relatively high value, and so indicate that the bounce position has been reached.

Alternatively, the determination can be made by ascertaining and comparing the vertical components of successive sections of the boundary line, which sections all have equal horizontal components. In that case, it will be noted that as the bounce position is closely approached the vertical component will suddenly reduce to a relatively low value, or even a negative value. Such a decrease indicates that the bounce position has been reached.

Figure 2:
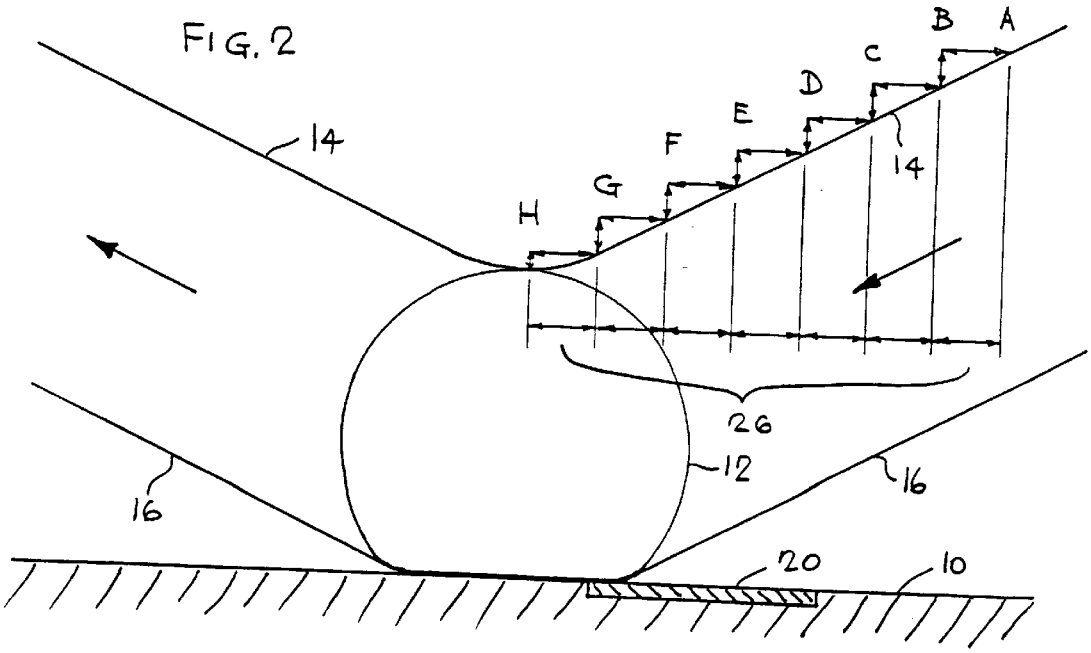

That alternative is illustrated in the FIG. 2, where the points A B C D E F G H on the upper boundary line 14 are all spaced apart in a horizontal direction by equal horizontal components 26 of the respective boundary line sections AB, BC, CD, DE, EF, FG, GH.

The vertical components of those sections are all equal as long as the declination of the boundary line remains constant. However, the declination reduces progressively when the ball makes contact with and becomes increasingly compressed against the playing surface. As a consequence the vertical component of the boundary section beyond G suddenly reduces to a relatively low value. That sudden reduction in the vertical component indicates the lowest position of the ball before rebounding from the playing surface (i.e. the rebound or bounce position).

Thus, it will be appreciated that as the bounce position is closely approached, the vertical component will suddenly reduced a relatively low value, or even a negative value, and so indicate that the bounce position has been reached.

It will be noted that those determinations of the bounce position have been made using the upper boundary line 14. However, providing appropriate measures can be taken in practice, there is no reason why corresponding determinations cannot be made using successive sections of the lower boundary line 16.

Those measures include making sure that the playing surface is quite plane at the reference line, and that the lower boundary line 16 can be observed by the relevant monitoring and scanning apparatus right down to the level of the playing surface.

Referring now to the FIGS. 3 to 6, one apparatus embodying the present invention comprises on one side of a tennis court (not indicated)—at the near end of a service line 28—a light source 30, and at the other side of the tennis court—at the far end of the service line 28—a light sensor array 32. Both the light source and sensor array have adjustable feet 34, 36 for enabling proper alignment of the light source and sensor array across the tennis court.

As shown in the FIG. 5, the light source comprises a light emitter 38 in the form of a collimated laser, a collimating lens system 40 for projecting a homogeneous, collimated beam of light 42 of uniform light intensity across the tennis court to the sensor array 32. That light beam has a transverse cross section of rectangular shape, and illuminates uniformly the whole of the front face 44 of the sensor array (which front face 44 is also indicated in FIG. 6 in alignment with the collimated light beam of FIG. 5).

Figure 3:
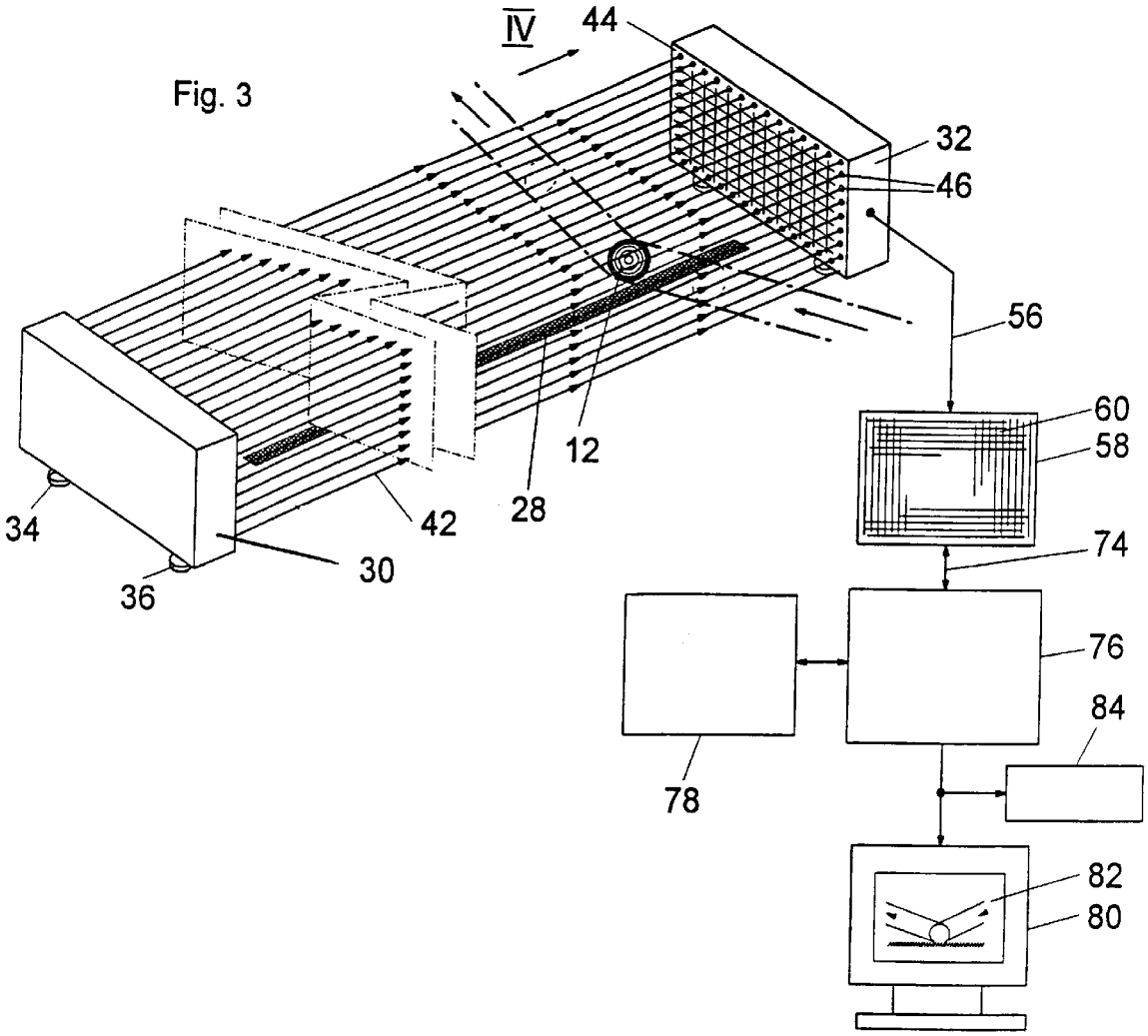
FIG. 3 shows pictorially and schematically the principal components of the apparatus and their respective relationships and inter-connections.
Figure 4:
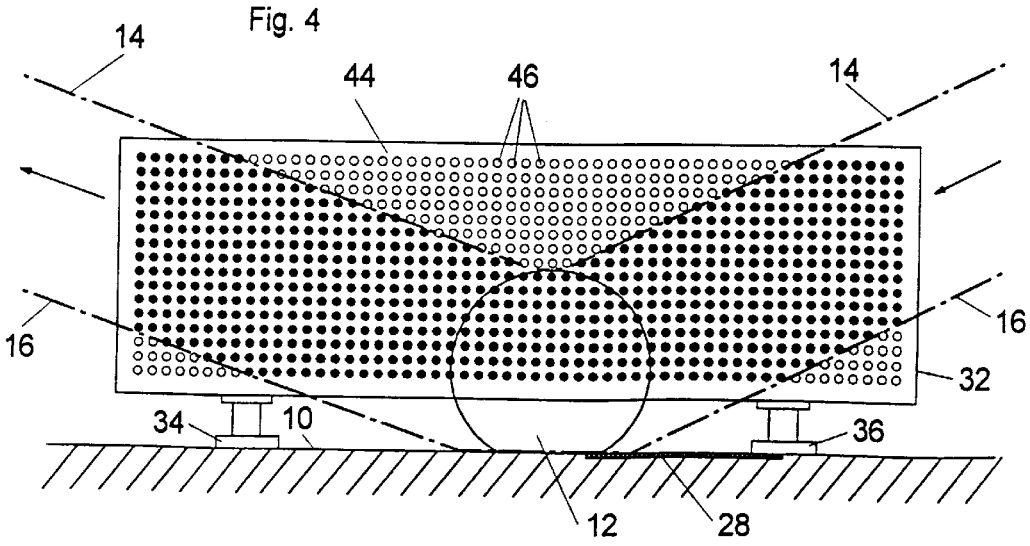
FIG. 4 shows a view, in the direction of the arrow IV of FIG. 3, of a photo-sensor array forming part of the apparatus.

As will be seen in FIG. 6, as well as in FIGS. 3 and 4, the sensor array 32 comprises a uniform matrix of light sensors 46. In FIG. 6, that array is shown as comprising sixteen sensors in each of sixty vertical columns. Those sensors have a pitch in each of the columns and rows of, for example, one milli-metre. As shown in the FIG. 7, each sensor 46 comprises a photo-diode 48 which is disposed at the output end of an optical fibre 'light pipe' 50. The free, input ends 52 of the light pipes are secured together with optical insulation therebetween to form the light sensitive front face 44 of the sensor array.

As will be seen in FIG. 3, the sensor array 32 has an electrical output channel 56 for feeding the output signals of the respective photo-diodes 48 to an electric signal storage array 58 which comprises a plurality of bistable circuit modules 60, one for each of the respective light sensors 46.

As shown in the FIG. 8, each bistable circuit module 60 comprises (a) a series electric circuit which includes the associated photo-diode 48 and a load resistor 61, and (b) an output circuit 62 which includes in series a high input impedance amplifying circuit 63. That output circuit 62 supplies (a) an OR gating circuit 64 for gating computer operations, and (b) an electronic bistable device 65. An output circuit 66 of the bistable device delivers an output signal indicative of the state of the bistable device (and hence of the state of illumination of the photo-diode 48) to a triszate device 68. The status of the tristate device 68 may be delivered to a computer data circuit 70 when that device receives a 'read' signal from the computer on an addressable read circuit 72.

The electric signal storage array 58 has an output channel 74 which communicates with a computer (digital processor) 76, (a) to receive address signals from the computer and (b) to transmit to the computer the states of the respective bistable devices 68 in response to the respective address signals delivered by the computer.

The computer has an associated memory 78 into which the states of the respective bistable devices 68 may be transferred for retention there until subsequently cancelled. The computer has also an associated monitor device 80, upon the screen 82 of which the computer can display the respective states of the bistable devices 68, as a series of bright areas on a dark background. Those bright areas are created in response to the absence of light at the respective associated photo-diodes 48. The screen of the monitor is of sufficient size to show the state of all the sensors in the sensor array.

In the absence of any light-obstructing object between the light source 30 and the sensor array 32, all of the light sensors in the array 32 are illuminated uniformly by respective elemental areas of the light beam 42, so that the corresponding bistable circuit modules 60 all indicate that illuminated condition of the sensors, and the whole of the monitor screen remains dark.

When a tennis ball enters the field between the light source 30 and the sensor array 32, the sensors 46 directly behind the tennis ball lie in the shadow of the ball and so receive no light from the light source. Thus, in turn the associated bistable circuit modules 60 record that new condition in which the sensors disposed behind the ball are not illuminated. In that condition, the monitor screen 82 shows bright illuminated areas corresponding to the un-illuminated sensors. In this way, a bright image of the tennis ball is portrayed on the monitor screen.

In the description that follows hereafter, it will be convenient to refer to a sensor as 'white' when it is illuminated by the light beam 42, and as 'black' when it is in the shadow of the ball and hence un-illuminated. Thus, a 'white' sensor is a sensor not obscured by the ball, whilst a 'black' sensor is a sensor which is obscured by the ball and hence not illuminated.

In FIG. 4, the flight path of the ball is indicated by the upper boundary line 14 and by the lower boundary line 16. The passage of the ball through the light beam thus causes all of the sensors between the upper and lower boundary lines 14 and 16 to become black sensors. All the other sensors remain white sensors.

This condition is recorded in the storage array 58 and also in the memory 78 of the computer 76, so that an image of the flight path of the ball may be displayed on the monitor screen 82.

In response to a command signal emitted when a ball enters between the light source 30 and the sensor array 32, the computer performs the following operations in order to find the point at which the ball has its most compressed condition, and from that position— the likely position of first contact of the ball with the playing surface of the tennis court, so that a determination can then be made as to whether the point of first contact lies within the service area or not.

Figure 9:
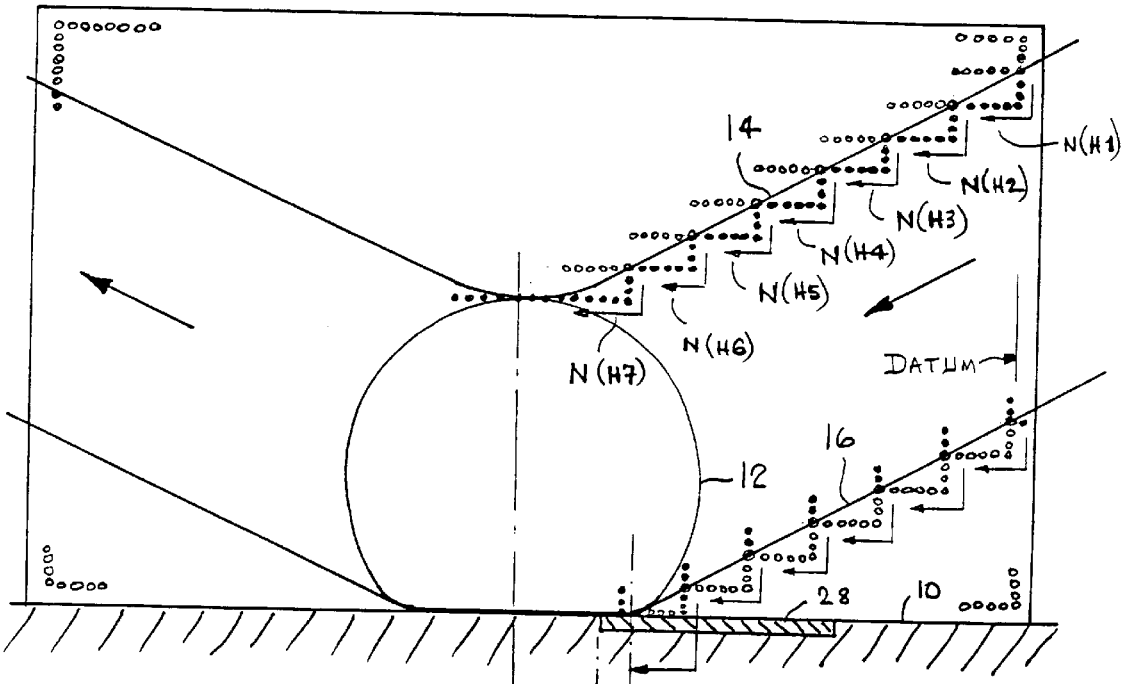
FIGS. 9 to 11 show various similar views of a tennis ball disposed at its maximum compression position in front of the light sensor array.

Referring now to FIG. 9, the computer scans down the first column at the entry side of the sensor matrix, from the uppermost sensor down to the first black sensor. On finding that first black sensor, the computer counts down a further three black sensors, and then scans horizontally the black sensors in that same row in the direction of ball flight until the first white sensor is located. The number N(H1) of sensors scanned in that row is noted in a part of the computer memory.

In the next stage, the computer counts down the column of that first white sensor a further three black sensors, and then scans horizontally the black sensors lying in that row to the left until the first white sensor in that row is located. The number N(H2) of sensors scanned in that row is noted in the computer memory, and is then compared with the number N(H1) of the previous stage to ascertain the difference, which in the present case is zero, since the gradient of the upper line 14 has not changed as between the first and second stages.

In the third stage, the computer counts down the column of that last located white sensor a further three black sensors, and then scans horizontally the black sensors lying in that row to the left until the first white sensor in that row is located. The number N(H3) of sensors scanned in that row is noted in the computer memory, and is then compared with the number N(H2) of the previous stage. Again the difference is zero, the gradient of the boundary line 14 not having changed since the previous stage.

Successive stages are completed in like manner until the seventh stage, when the number N(H7) is found to have substantially exceeded the value of the number N(H6), thus indicating that there has been a substantial change in the gradient of the boundary line 14, and that the position of the greatest ball compression has been reached.

The addition of the series of numbers N(H1) to N(H7) indicates a distance of the fully compressed ball position from the starting datum, and the substraction from that distance of the distance of the rearward edge of the service line from the same datum will indicate whether the compressed ball lies straddling the service line, or to one side or the other of that line.

Compensation for the distance between the position of first contact of the ball with the ground and the position of the fully compressed ball can be derived by suitable analysis in the computer having regard to the angle of declination of the flight path as determined in a predetermined number of stages earlier, and the ball speed. Alternatively, that distance may be determined experimentally for a number of different angles of declination of the flight path, and ball speed, and stored in the computer memory.

An audible alarm device 84 may be activated by the computer to give an audible alarm when the first point of contact of the ball with the ground lies rearward of the service line.

Whereas the above process has been described in relation to the upper boundary line 14, providing the sensor array and light beam extend down to the ground level, the process could be carried out on the lower boundary line 16, as likewise illustrated in the FIG. 9.

Figure 10:
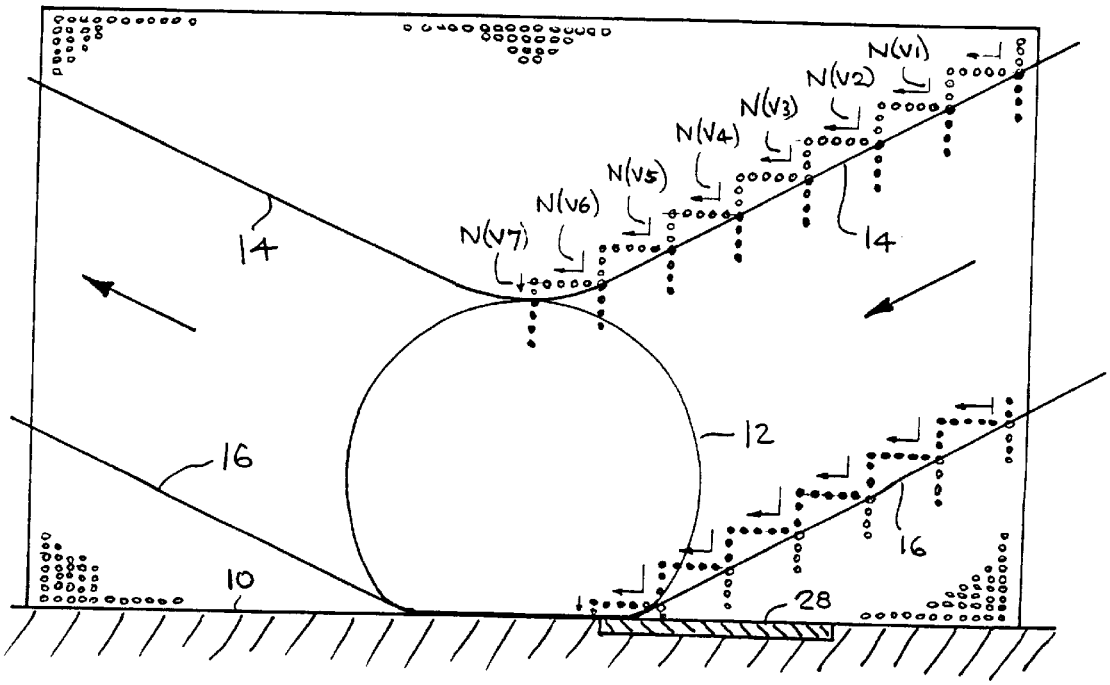

In FIG. 10, there is illustrated an alternative method of determining the position of maximum ball compression, and hence the position of ball first contact with the ground relative to the service line.

In this alternative method, the computer first scans down the right hand column of sensors to find the first black sensor, whereupon the computer counts horizontally to the left along the row of that first black sensor a predetermined number of white sensors (i.e. of columns), in this case five columns, and then scans down that column to find the first black sensor. The computer counts the number N(V1) of sensors scanned in that column.

The computer then repeats that process in stage two to find the number N(V2), and then compares that number with the number N(V1) determined in the previous stage. Since the gradient of the boundary line 14 has not changed as between the respective sections of the boundary line 14, the difference of the two numbers is zero.

The same procedure is repeated for successive sections of the boundary line 14 until the difference between one such number and the previous one has fallen by a substantial amount, thus indicating that the angle of declination of the boundary line has fallen to a low value of the order of zero, or even a negative value. This marks the position of maximum compression of the ball, which position can be compared with the position of the service-line, and which position can be compensated for the difference between the positions of maximum compression of the ball and first contact with the ground.

As in the case of FIG. 9, the process may be carried out alternatively on the lower boundary line 16, with the same provisoes.

Whereas in the procedures just described with reference to the FIGS. 9 and 10, the determinations of the respective numbers N(H1) to N(H7) have related to consecutive, non-overlapping sections of the boundary line 14 (or 16), if desired (and it is preferred) the determinations may be made on overlapping sections, thus to provide a 'rolling-over' procedure which is capable of giving a more refined determination, resulting in greater accuracy in the determination of ball position.

If desired the procedure described above with reference to the FIG. 9 (or that of FIG. 10) may be supplemented by carrying out the the same procedures from both the right and left hand ends of the sensor array in opposite directions, either simultaneously or consecutively, to arrive at complementary determinations, which will either confirm one another, or otherwise provide by an average of the respective determinations the position of maximum compression of the ball.

In a modification of the method of determining that position of the ball described with reference to FIG. 9, the value of the number N(H6), for example, may be ascertained in the corresponding procedures of that Figure as carried out from both ends of the array.

Those numbers in conjunction with the numbers of sensors counted down in the corresponding vertical components of the respective right and left hand boundary line sections determine the respective gradients of those right and left sections of the boundary line 14. From those gradients, the computer can compute the position of intersection of those gradients as extended towards the position of maximum compression of the ball. That intersection will lie on the line defining the maximum compression position of the ball.

Figure 11:
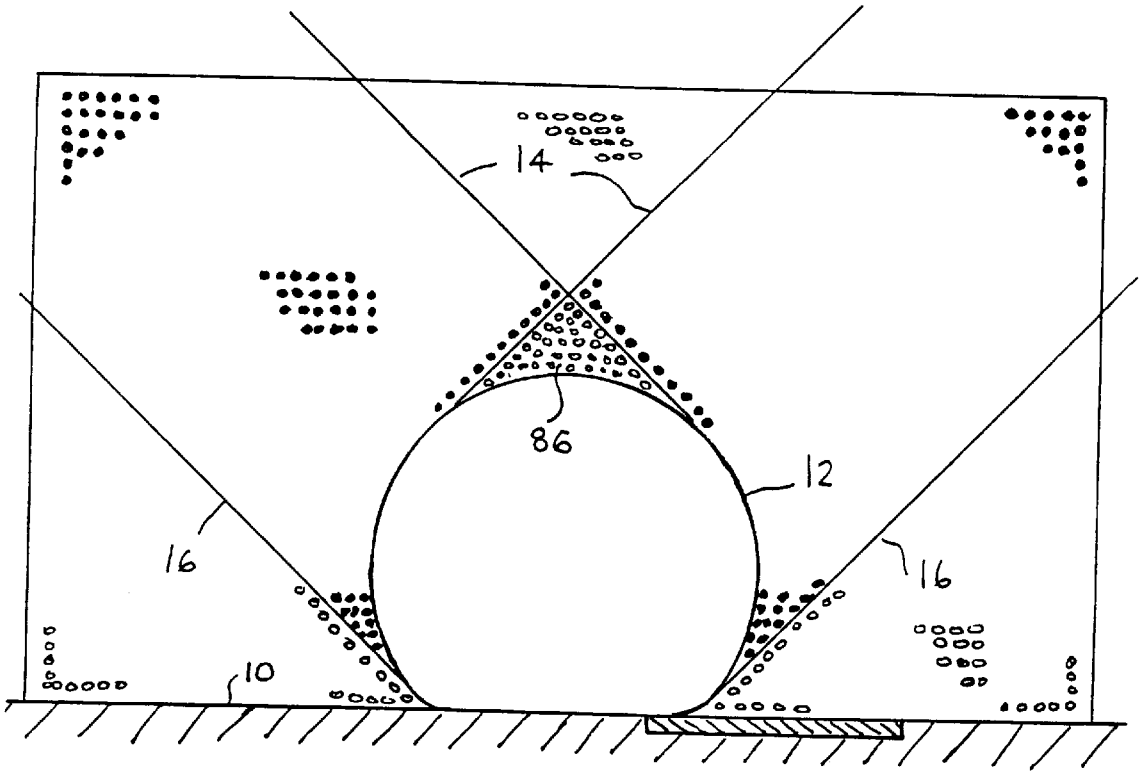

FIG. 11 shows the flight path of a ball which descends on to the playing surface at a relatively steep angle (i.e. at a high declination angle). In that case, the sensors in the triangular area 86 above the ball as defined by the respective right and left hand parts of the upper boundary line 14 will be triggered to the black state on the first descent of the ball, so that on the rebound of the ball those sensors will already be in the black state unless special precautions are taken to enable the left hand part of the boundary line 14 to be recorded. To this end, the bistable circuit modules 60 are arranged to be triggerable back to their former white state on being triggered a second time, that is, on the rebound of the ball. Hence, in a monitor display of this type of steep decent of the service ball the sensors in that triangular area 86 will be seen as a black area superposed on the illuminated display of the rest of the flight path of the ball. The cross-over point at the top of the triangular area lies over and hence denoteds the position of maximum compression of the ball.

By scanning both the right and left hand portions of the upper boundary line 14 oppositely from both ends of the sensor array and determining the location and gradients of the right and left hand parts of the upper boundary line 14, their point of intersection can be determined as denoting the position of maximum compression of the ball.

Figure 12:
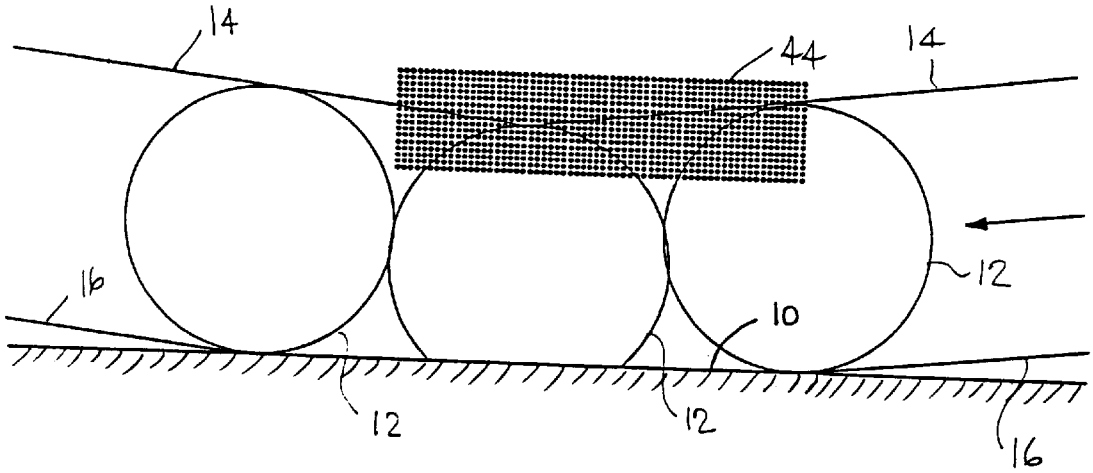
FIGS. 12 and 13 show views similar to those of the FIGS. 9 to 11, but indicating typical true proportions of a tennis ball and the light sensor array.
Figure 13:
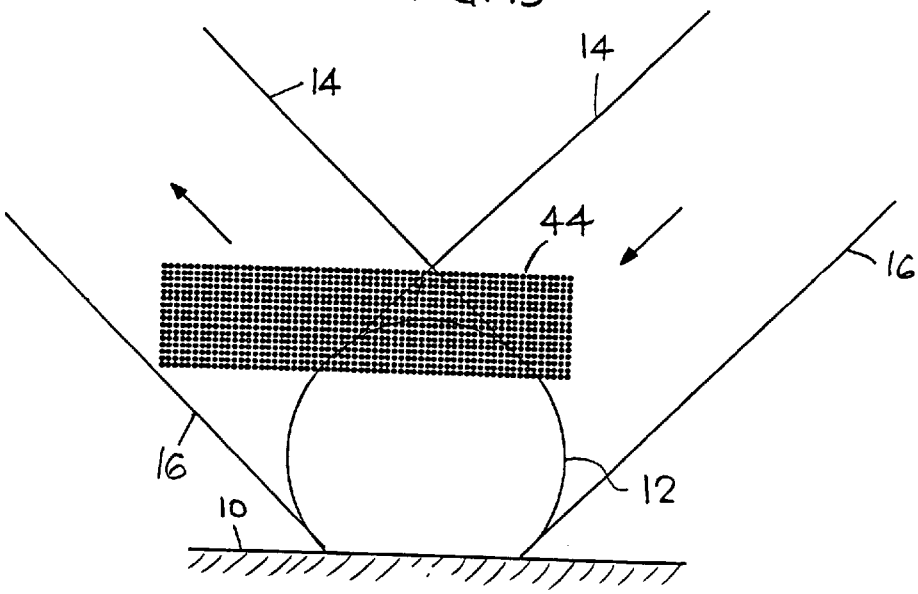

FIGS. 12 and 13 show in proper proportions the size of a tennis ball in relation to the sensor array which is illustrated in FIG. 6, for the respective shallow and steep descents of the service ball.

Whereas in the apparatus described above, the light source has emitted light in the visible part of the spectrum, other sorts of energy radiation may be used with appropriate forms of radiation sensor.

The apparatus described above has the merit that there is no need to carefully align each light sensor with its own individual light source. All of the sensors respond to the common collimated light beam, so that the problems of alignment of the light source and sensor array is minimised.

It is important to the success of the present invention that the light sensor array is illuminated by a single homogeneous collimated light beam. A matrix of small, individual light sources, for illuminating the respective light sensors of the array would not suffice, due to the relatively greater dispersion of light beams emitted from such small light sources.

Such relatively greater dispersion of light beams from small individual light sources would mean that each light sensor would be affected by light from other ones of the light sources besides its own particular light source. Hence, such a matrix of small light sources would not produce a sufficiently well defined representation of a tennis ball passing between the light source 30 and the light sensor array 32.

I claim:

1. A method of monitoring in a ball game the position relative to a reference line (20, 28) extending linearly between near and far ends thereof, of the first contact of a game ball (12) with a playing surface (10) carrying said reference line (20, 28), which method includes the following steps:

(a) from said near end of the reference line (20, 28), directing a single homogeneous collimated radiation beam (42) of substantially parallel separate rays of radiation along said reference line (20, 28) so as to irradiate a predetermined field (44) at said far end of the reference line (20, 28) lying adjacent the reference line (20, 28), said radiation beam (42) having a transverse cross section such as will be materially but not wholly interrupted by the passage of the game ball (12) through the beam (42) when in play near said reference line (20, 28);

(b) at the far end of the reference line (20, 28), receiving at closely spaced locations (46) in said field (44) respective separate spaced rays of said radiation beam (42), which locations (46) are disposed in a column and row, or similar formation;

(c) converting the respective received separate rays of beam radiation into corresponding electrical signals;

(d) storing the respective electrical signals in respective signal storage elements (60) of a storage means (58) for retention therein until reset by the passage of the game ball (12) through the radiation beam (42), each said storage element (60) when storing a said electrical signal representing a ray of said radiation beam (42) which is not interrupted by the game ball (12), and each said storage element when not so storing a said electrical signal representing a ray of said radiation beam (42) which is interrupted by the game ball (12);

(e) deriving from said storage means (60) a representation of the path (14, 16) of an upper or a lower peripheral part of the game ball (12) as the game ball (12) impacts and bounces on the playing surface (10) at or near the reference line (20, 28) whilst passing through the radiation beam (42);

(f) observing changes in the declination of that path (14, 16); and (g) deriving from the changes in declination of that path (14, 16) the position of first contact of the game ball (12) with the playing surface (10).

2. A method according to claim 1 wherein step (e) includes the step of energizing a visual display means (80) in dependence upon the states of the respective storage elements (60) of the storage means (58) so as to display on a visual display screen (82) thereof said representation of the path (14, 16) of said upper or lower part of the game ball (12) during its passage through the radiation beam (42).

3. A method according to claim 1 including the step of scanning the storage elements (60) to determine a boundary separating those storage elements (60) currently storing a said electric signal and those not so storing a said electrical signal, thereby to determine the path (14) of an upper peripheral part of the game ball (12) during its passage through the radiation beam (42).

4. A method according to claim 1 including the step of scanning the storage elements (60) to determine a boundary separating those storage elements (60) currently storing a said electric signal and those not so storing a said electric signal, thereby to determine the path (16) of a lower peripheral part of the game ball (12) during its passage through the radiation beam (42).

5. A method according to claim 3 including the step of determining from said path (14, 16) the position of the first contact of the game ball (12) with the playing surface (10).

6. A method according to claim 5 including the step of determining the gradient of the path (14, 26) at successive positions (A, B, C . . . H) spaced along the path (14, 16), determining the location on the path (14, 16) at which the gradient changes rapidly by a substantial amount, and from that location determining the position of the first contact of the game ball (12) with the playing surface (10).

7. A method according to claim 5, including the step of determining the angle of declination of the path (14, 26) at said successive positions (A, B, C, . . . , H) spaced along the path (14, 16), comparing successive values of that angle and noting the location of the game ball (12) relative to the reference line (20, 28) at which the angle reduces rapidly towards zero value, and from that location determining the position of the first contact of the game ball (12) with the playing surface (10).

8. A method according to claim 7 wherein a substantial change in the angle of declination of said path (14, 16) is determined by noting the horizontal component of successive sections (AB, BC, . . . GH) of said path (14, 16), which sections (AB, BC, . . . GH) all have equal vertical components (24,) comparing successive values of said horizontal component, and noting the location of the game ball (12) relative to the reference line (20, L28) at which the value of the horizontal component increases rapidly to a high value.

9. A method according to claim 7 wherein a substantial change in the angle of declination of said path (14, 16) is determined by noting the vertical component of successive sections (AB, BC, . . . GH) of the path (14, 16), which sections (AB, BC, . . . GH) all have equal horizontal components (26), comparing successive values of said vertical component, and noting the location of the game ball (12) relative to the reference line (20, 28) at which the value of the vertical component reduces rapidly to a low value.

10. A method according to claim 1 wherein said radiation (42) comprises visible light.

11. Apparatus for monitoring in a ball game the position relative to a reference line (20, 28) extending linearly between near and far ends thereof, of the first contact of a game ball (12) with a playing surface (10) carrying said reference line (20, 28), which apparatus comprises:

(a) disposed at said near end of the reference line (20, 28), a radiation emitting means (30, 38, 40) for directing a single homogenous collimated radiation beam (42) of substantially parallel separate rays of radiation along said reference line (20, 28) so as to irradiate a predetermined field (44) at said far end of the reference line (20, 28) lying adjacent the reference line (20, 28), said radiation beam (42) having a transverse cross section such as will be materially but not wholly interrupted by the passage of the game ball (12) through the beam (42) when in play near said reference line (20, 28);

(b) disposed at said far end of the reference line (20, 28), a plurality of radiation receiving means (32, 46) for receiving at closely spaced locations (46) in said field (44) respective separate radiation rays of said radiation beam (42), which locations (46) are disposed in a column and row, or similar, formation;

(c) a plurality of signal converting means (48, 61–68) for converting the respective received rays of said radiation beam (42) into respective corresponding electrical signals;

(d) signal storage means (58) for storing the respective electrical signals in respective signal storage elements (60) of the storage means (58) until reset by the passage of the game ball (12) through the radiation beam (42);

(e) scanning means (76) for deriving from the storage means (58) a representation of the flight path (14, 16) of an upper or a lower peripheral part of the game ball (12) as the game ball (12) impacts and bounces on the playing surface (10) at or near the reference line (20, 28) whilst passing through the radiation beam (42);

(f) means (76) for observing the declination of the flight path (14, 16) at successive positions (A, B, C, . . . H) on the flight path (14, 16);

(g) means (76) for deriving from changes in the declination of the flight path (14, 16) the position of first contact of the game ball (12) with the playing surface (10).

12. Apparatus according to claim 11 including a visual display means (80) and means (68) for energizing the visual display means (80) in dependence upon said stored electrical signals so as to display on a visual display screen (82) thereof a spatial representation of the respective radiation rays received at said far end of the reference line (20, 28) by said radiation receiving means (32, 46), thereby to represent on the screen (82) the flight path (14, 16) of the game ball (12) through the radiation beam (42).

13. Apparatus according to claim 11 including scanning means (76) for scanning the respective signal storage elements (60) for scanning the respective signal storage elements (60) to determine a boundary separating those storage elements (60) currently storing a said electric signal and those not so storing a said electric signal, thereby to determine the path (14) of an upper peripheral part of the game ball (12) whilst passing through the radiation beam (42).

14. Apparatus according to claim 11 including scanning means (76) for scanning the respective signal storage elements (60) to determine a boundary separating those storage elements (60) currently storing a said electric signal and those not so storing a said electric signal, thereby to determine the path (16) of a lower peripheral part of the game ball (12) whilst passing through the radiation beam (42).

15. Apparatus according to claim 13 including means (76) for determining from said path (14, 16) the position of the first contact of the game ball (12) with the playing surface (10).

16. Apparatus according to claim 15 including means (76) for determining the gradient of the path (14, 16) at successive positions (A, B, C, . . . H) spaced along the path (14, 16) means (76) for determining the location on the path (14, 16) at which the gradient changes rapidly by a substantial amount, and means (76) for determining from that location the position of the first contact of the game ball (12) with the playing surface (10).

17. Apparatus according to claim 15 including means (76) for determining the angle of declination of the path (14, 16) at successive positions (A, B, C, . . . H) spaced along the path (14, 16), comparing means (76) for comparing successive values of that angle and noting the location of the game ball (12) relative to the reference line (20, 28) at which the angle reduces rapidly towards zero value, and means (76) for determining from that ball location the position of the first contact of the game ball (12) with the playing surface (10).

18. Apparatus according to claim 15 including means (76) for detecting a substantial and rapid change in the angle of declination of said path (14, 16), which means includes means arranged to determine for successive sections (AB, BC, . . . GH) of said path (14, 16) the horizontal component of those path sections (AB, BC, . . . GH), which path sections (AB, BC, . . . GH) all have equal vertical components (24), comparing means (76) for comparing successive values of said horizontal component and arranged to provide a signal denoting the location of the game ball (12) relative to the reference line (20, 28) at which the horizontal component increases rapidly to a high value, and means (76) for determining from that ball location the position of the first contact of the game ball (12) with the playing surface (10).

19. Apparatus according to claim 15 including means (76) for detecting a substantial and rapid change in the angle of declination of said path (14, 16), which means includes means arranged to determine for successive sections (AB, BC, . . . GH) of said path (14, 16) the vertical component of those path sections (AB, BC, . . . GH), which path sections (AB, BC, . . . GH) all have equal horizontal components (26), comparing means (76) for comparing successive values of said vertical component and arranged to provide a signal denoting the location of the game ball (12) relative to the reference line (20, 28) at which the vertical component reduces rapidly to a low value, and means (76) for determining from that ball location the position of the first contact of the game ball (12) with the playing surface (10).

20. An apparatus according to claim 11 wherein the radiation emitting means (30, 38, 40) comprises a means for emitting a single homogeneous beam (42) of light.

* * * * *

UNITED STATES PATENT AND TRADEMARK OFFICE

CERTIFICATE OF CORRECTION

PATENT NO. : 6,024,658

DATED : February 15, 2000

INVENTOR(S) : John Reuben MARSHALL

It is certified that error appears in the above-indentified patent and that said Letters Patent is hereby corrected as shown below:

IN THE ABSTRACT ON THE TITLE PAGE ITEM [57],

Line 9, "definition" should read -- declination -- and
Line 11, "lower" should read -- low --.

Column 6, line 44, "triszate" should read -- tristate --; and
Column 9, line 45, "denoteds" should read -- denotes --.

Claim 13, lines 40 and 41, please delete "for scanning the respective signal storage elements (60)".

Signed and Sealed this

Third Day of April, 2001

*Attest:*

Nicholas P. Godici

NICHOLAS P. GODICI

*Attesting Officer*

*Acting Director of the United States Patent and Trademark Office*